US010966499B2

(12) United States Patent
Armstrong et al.

(10) Patent No.: US 10,966,499 B2
(45) Date of Patent: Apr. 6, 2021

(54) POCKETBOOK LIGHT DEVICE

(71) Applicants: Kevin Armstrong, Sewaren, NJ (US); Carla Harris, Sewaren, NJ (US)

(72) Inventors: Kevin Armstrong, Sewaren, NJ (US); Carla Harris, Sewaren, NJ (US)

( * ) Notice: Subject to any disclaimer, the term of this patent is extended or adjusted under 35 U.S.C. 154(b) by 33 days.

(21) Appl. No.: 15/139,098

(22) Filed: Apr. 26, 2016

(65) Prior Publication Data

US 2016/0316879 A1 Nov. 3, 2016

Related U.S. Application Data

(60) Provisional application No. 62/154,959, filed on Apr. 30, 2015.

(51) Int. Cl.
*A45C 15/06* (2006.01)
*F21V 33/00* (2006.01)

(52) U.S. Cl.
CPC ..... *A45C 15/06* (2013.01); *F21V 33/0004* (2013.01)

(58) Field of Classification Search
CPC ..... A45C 15/06; F21V 33/0004
See application file for complete search history.

(56) References Cited

U.S. PATENT DOCUMENTS

2003/0090895 A1* 5/2003 Guerrieri ..... A45C 15/06 362/156
2005/0195611 A1* 9/2005 Burt ..... F21V 15/00 362/376
2012/0147594 A1* 6/2012 Tait ..... A45C 3/06 362/156
2014/0233224 A1* 8/2014 Lemon ..... F21V 23/0464 362/191

* cited by examiner

*Primary Examiner* — Anh Mai
*Assistant Examiner* — Nathaniel Lee
(74) *Attorney, Agent, or Firm* — Ruth Eure

(57) ABSTRACT

A pocketbook light device for illuminating a low light area is provided. The pocketbook light device comprises an openable carrying accessory and a housing having a front side and a rear side. The housing is mountable within the carrying accessory. A plurality of lights is mounted in the front side of the housing. An activation mechanism activates the plurality of lights. Upon activation of the plurality of lights, the plurality of lights illuminate the interior of the carrying accessory.

3 Claims, 2 Drawing Sheets

POCKETBOOK LIGHT DEVICE

CLAIM OF PRIORITY

This patent application claims priority under 35 USC 119 (e)(1) from U.S. Provisional Patent Application Ser. No. 62/154,959 filed Apr. 30, 2015, of common inventorship herewith entitled, "Pocketbook Light," which is incorporated herein by reference as though the same were set forth in its entirety.

FIELD OF THE INVENTION

The present invention pertains to the field of illumination sources, and more specifically to the field of light sources in carrying accessories.

BACKGROUND OF THE INVENTION

Inventions are always a product of vision and creativity whether they are world changing inventions like cars and computers or everyday conveniences like pump hairsprays, cordless tools and resealable soda bottles. New inventions like a cell phone change a person's life style, making communication more convenient and accessible virtually anywhere. Other inventions such as a snow scraper and brush combine two already existing inventions into an improved embodiment, reducing clutter in our lives and making a daily winter chores much easier. Often necessity combined with a little creativity is the underlying motivator for an invention. Most inventions fill a relatively small need or perform a specialized limited function.

Just as travelers carry a variety of needed possessions in their luggage, individuals carry a wide variety of items in purses or pocketbooks, from car keys and cellphone to makeup. People also carry items in carrying accessories such as briefcases, computer cases, carryall bags, backpacks, messenger bags and cyclist bags. Often, people must quickly locate an article within their preferred carrying accessory. Finding the article during daylight hours is relatively easy and straightforward, but practically impossible during nighttime hours or in a darkened location.

The prior art has put forth several designs for light sources in carrying accessories. Among these are:

US Patent 2012/0212940 to Tamara Ann Leuty describes an application of a lighting source, EL or similar, built within the bottom or side of a purse such as a clutch, tote, handbag, shoulder bag, makeup, or shoulder type bag. When illuminated, this lighting source helps see the contents of the bag. This application includes a method of installing the wiring, power mechanism, and on off switch mechanism that is manual or magnetic. This method is applicable for a lighting source installation within the interior of a man's or woman's purse, clutch, tote, handbag, shoulder bag, makeup, or shoulder type bag.

US Patent 2010/0053941 to Cherl Ann Ibison describes a security light purse having a purse light disposed in an interior compartment of the purse body so as to light up the compartment to enable the user to more easily find one or more objects inside the purse. In a preferred embodiment, the purse light comprises a flexible light panel having a plurality of LEDs or other light sources disposed about the periphery of the light panel. The light sources connect to batteries disposed inside a battery compartment at the bottom of the purse. A recharge port facilitates recharging the batteries. The purse has an alarm unit operatively connected to the purse's handles such that the alarm is activated when the handles are pulled from the purse body during an attempted purse snatching. The preferred purse also has a safety device mechanism for securing a personal safety device, such as mace, to the purse for ready use.

US Patent 2008/0198585 to Cynthia K. Tait describes a purse illumination assembly, comprising a purse having at least two sides, wherein the inside of at least one of the at least two sides is light emitting fabric. A power source means is coupled operatively to the light emitting fabric. A switch means is coupled operatively to the power source means.

None of these prior art references describe the present invention.

SUMMARY OF THE INVENTION

It is an object of the present invention to provide a bright, battery powered LED light source that illuminates contents of carrying accessories such as purses, carryall bags, luggage, briefcases, computer carriers, messenger bags, backpacks and cyclist bags.

The present invention is a pocketbook light device for illuminating a low light area is provided. The pocketbook light device comprises an openable carrying accessory and a housing having a front side and a rear side. The housing is mountable within the carrying accessory. A plurality of lights is mounted in the front side of the housing. An activation mechanism activates the plurality of lights. Upon activation of the plurality of lights, the plurality of lights illuminate the interior of the carrying accessory.

In addition, the present invention includes a method for illuminating a low light area. The method comprises providing an openable carrying accessory, mounting a housing within the carrying accessory with the housing having a front side and a rear side, mounting a plurality of lights in the front side of the housing, activating the plurality of lights, and illuminating the interior of the carrying accessory.

The present invention further includes a pocketbook light device for illuminating a low light area. The pocketbook light device comprises an openable carrying accessory and a housing having a front side and a rear side. The housing is mountable within the carrying accessory. An attachment mechanism releasably secures the housing to the carrying accessory. A plurality of lights is mounted in the front side of the housing with a portion of the housing being beveled at a border between the housing and each light. An activation mechanism activates the plurality of lights. Upon activation of the plurality of lights, the plurality of lights illuminate the interior of the carrying accessory.

DETAILED DESCRIPTION OF THE INVENTION

Figure 2:
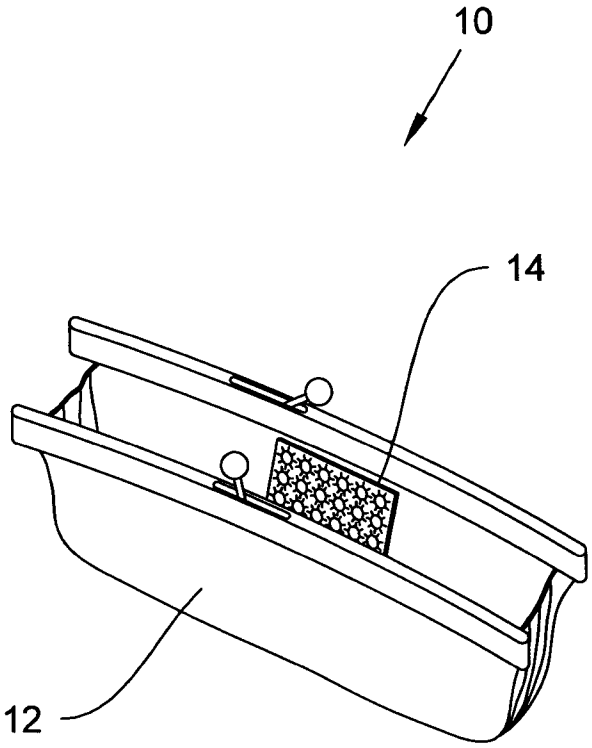
FIG. 2 is a perspective view illustrating the pocketbook light device, constructed in accordance with the present invention, showing the pocketbook light device within a small handheld clutch purse.
Figure 1:
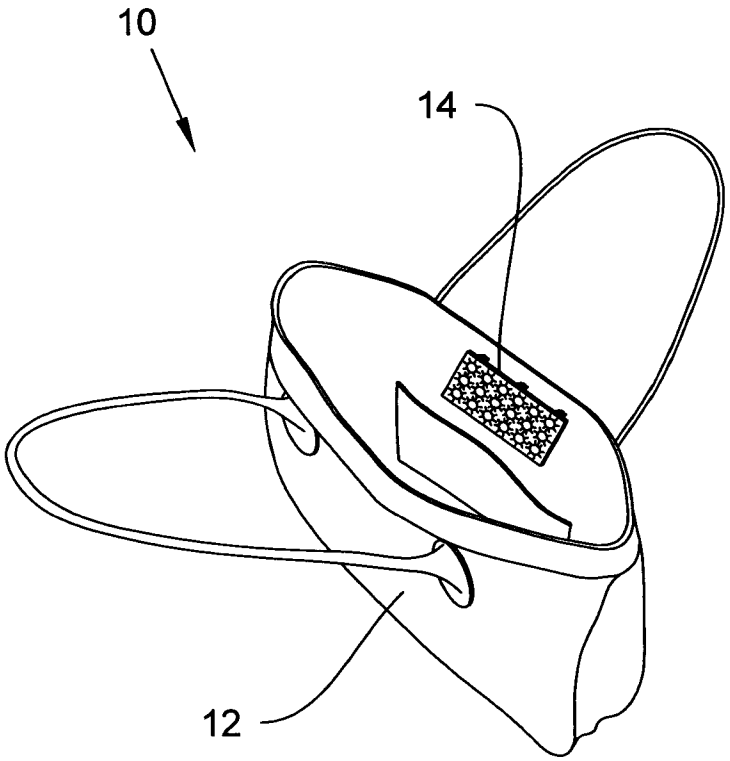
FIG. 1 is a perspective view illustrating a pocketbook light device, constructed in accordance with the present invention, showing a pocketbook light device within a large bag type pocketbook.
Figure 3:
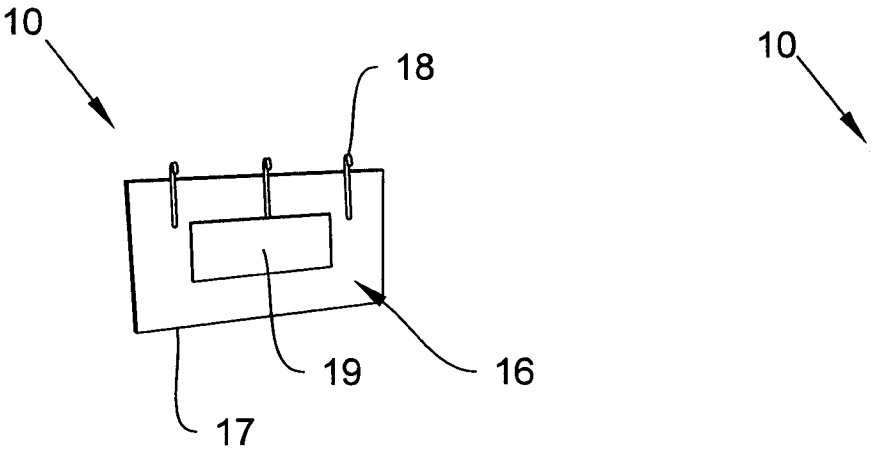
FIG. 3 is a rear perspective view illustrating the pocketbook light device, constructed in accordance with the present invention, showing a rectangular shaped pocketbook light device with attachable hooks.
Figure 4:
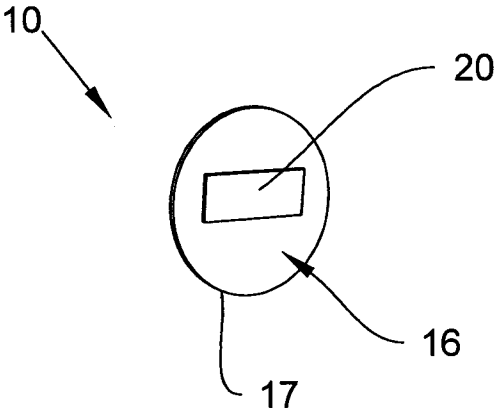
FIG. 4 is a rear perspective view illustrating the pocketbook light device, constructed in accordance with the present invention, showing a circular shaped pocketbook light device with an adhesive tape backing strip.
Figure 5:
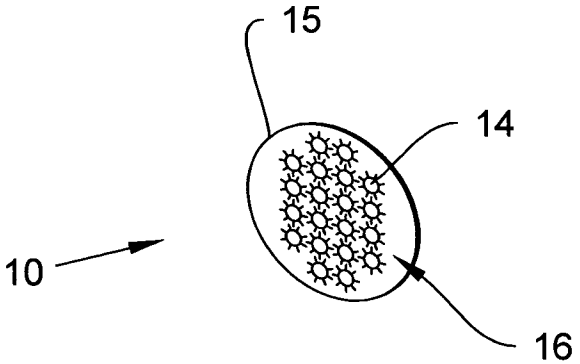
FIG. 5 is a front perspective view illustrating the pocketbook light device, constructed in accordance with the present invention, showing a rectangular shaped pocketbook light device in an activated, illuminated state of bright lighting.
Figure 6:
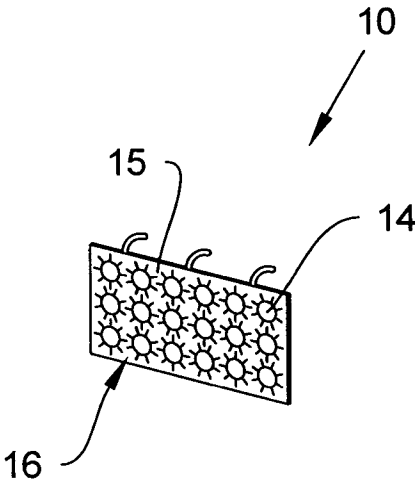
FIG. 6 is a front perspective view illustrating the pocketbook light device, constructed in accordance with the present invention, showing a circular shaped pocketbook light device in an activated, illuminated state of bright lighting.

The present invention, hereinafter referred to as the Pocketbook Light Device, indicated generally at 10, is a bright, battery powered LED light source that illuminates the contents of a carrying accessory 12, purse, or bag when opened. The Pocketbook Light Device 10 is incorporated into production of carrying accessories 12 such as new purses, luggage pieces, briefcases, computer cases, carryall bags, backpacks, messenger bags, and cyclist totes. The Pocketbook Light Device 10 of the present invention also is available as an add-on accessory for existing carrying accessories 12.

The Pocketbook Light Device 10 of the present invention comprises a compact Light Emitting Diode or LED array 14 containing approximately two to nine bright LED bulbs. The LED bulbs 14 are encased within a housing 16 and powered by a replaceable, long life, pill type lithium ion battery. Preferably, the housing 16 has a round, square, or rectangular shape although having a housing 16 of any shape is within the scope of the present invention. The housing 16 has a front side 15 and a rear side 17 with the LED bulbs 14 mounted to the front side 15 of the housing 16. In an embodiment, the housing 16 for the LED bulbs 14 preferably is beveled at the borders between the LED bulbs 14 and the housing 16 to disperse the light outward for the best possible coverage pattern and optimal illumination. When incorporated into the manufacture of new carrying accessories 12, the Pocketbook Light Device 10 of the present invention is affixed in a permanent but detachable manner to the lining or interior frame of the carrying accessory 12. The incorporated Pocketbook Light Device 10 is preferably configured to activate upon opening the carrying accessory 12. Automatic activation is achievable, for example, through a light sensor switch or a switch activated by the clasp, lock, or hinge located on the carrying accessory 12 automatically activated upon opening of the carrying accessory and automatically deactivated upon closing of the carrying accessory.

As an aftermarket accessory, the Pocketbook Light Device 10 of the present invention is equipped to be fastened to an interior lining or frame of the carrying accessory 12 by an attachable means such as physical hooks 18 mounted along a top edge of the housing 16, a pin clip, an adhesive backed hook and loop strip 19 mounted on the rear side 17 of the housing 16, or a peel and stick adhesive backing strip 20 mounted on the rear side 17 of the housing 16. As an aftermarket accessory, the Pocketbook Light Device 10 is activated through an auditory sensor for voice activation or a light sensor activated by low levels of ambient light and deactivated by high levels of ambient light. An alternative activation means may be a simple On and Off pressure switch, linked to the LED array 14 by a wiring connection that is mounted within the clasp, lock or hinge of the carrying accessory 12.

The Pocketbook Light Device 10 of the present invention provides an invaluable service of illuminating the contents of an individual's carrying accessory 12 when opened at night or in a poorly illuminated place. Operating automatically when the carrying accessory 12 is opened, the Pocketbook Light Device 10 provides light when needed. The Pocketbook Light Device 10 effectively functions as an emergency flashlight for times when a bright light is required, such as a roadside vehicular break down at night or needing to quickly unlock one's door at night.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claim.

The invention claimed is:

1. A pocketbook light device for illuminating a low light area, the pocketbook light device comprising:

an openable carrying accessory;

a housing having a front side and a rear side, the housing mountable within the carrying accessory;

a plurality of lights mounted on the front side of the housing; and an activation mechanism for activating the plurality of lights;

wherein upon activation of the plurality of lights, the plurality of lights illuminate the interior of the carrying accessory and further comprising:

an attachment mechanism for releasably securing the housing to the carrying accessory wherein the attachment mechanism is a plurality of hooks mounted adjacent a top edge of the housing.

2. The pocketbook light device of claim 1, wherein the attachment mechanism is an adhesive backed hook and loop strip mounted to the rear side of the housing.

3. The pocketbook light device of claim 1, wherein the attachment mechanism is a peel and stick adhesive backing strip mounted to the rear side of the housing.

* * * * *